United States Patent [19]

Fischer

[11] Patent Number: 4,675,505

[45] Date of Patent: Jun. 23, 1987

[54] STEPPED OUTPUT STEAM HUMIDIFIER

[75] Inventor: David W. Fischer, Kalamazoo, Mich.

[73] Assignee: Armstrong International, Inc., Three Rivers, Mich.

[21] Appl. No.: 820,506

[22] Filed: Jan. 21, 1986

[51] Int. Cl.[4] ..... B65B 43/38

[52] U.S. Cl. ..... 219/295; 219/272; 236/44 R; 236/46 F; 236/78 D

[58] Field of Search ..... 236/44 A, 44 R, 46 F, 236/78 C, 78 D; 219/272, 295, 286; 62/158, 176.2; 340/588

[56] References Cited

U.S. PATENT DOCUMENTS

| | | | |
|---|---|---|---|
| 3,101,432 | 8/1963 | Adams | 62/158 X |
| 3,277,458 | 10/1966 | Greenwood | 340/588 |
| 4,146,775 | 3/1979 | Kirchner et al. | 219/272 X |
| 4,184,340 | 1/1980 | Laughlin et al. | 62/158 X |

*Primary Examiner*—William E. Wayner

*Attorney, Agent, or Firm*—Flynn, Thiel, Boutell & Tanis

[57] ABSTRACT

A vaporizing humidifier includes a portion for providing stepwise increases and decreases in vapor output capacity in response to the duration of a vapor demand signal, for matching the vapor output to the demand therefore.

15 Claims, 10 Drawing Figures

STEPPED OUTPUT STEAM HUMIDIFIER

FIELD OF THE INVENTION

This invention relates to a humidifier apparatus of the kind incorporating an electrode-type steam generator.

BACKGROUND OF THE INVENTION

Humidifiers of various types are known. Steam generating humidifiers are advantageous. The boiling of supply water to produce steam tends to kill bacteria if present in the water reservoir. Minerals in the supply water tend to remain in the heated water reservoir. Thus a clean sterile vapor is distributed to the environment.

It is known to generate steam by immersing electrodes in a supply of water in the water reservoir so that the electric current flows through the water between the electrodes and heats same to generate steam. The current amperage, and thus the amount of steam generated, depends on the electrical conductivity of the water and on the depth to which the electrodes are immersed in the water. It is customary in such apparatus to use ordinary tap water having some degree of mineral content and to periodically drain some of the water in the evaporating tank to prevent an excessive build-up of mineral concentration, so as to keep the electrical conductivity of the water in a desired range. It is typical to monitor the amperage of heating current flow through the electrodes and to open and close a water fill valve controlling water inflow to the steam generator tank in response to heating current going above or below a desired range. A humidity sensing circuit may vary the range, for example to increase electrode current amperage and thereby steam generating rate, in response to a decrease in atmospheric humidity, thereby to increase atmospheric humidity to a desired level, wherein a manual adjustor selects the desired humidity level. An example of a prior art humidifier incorporating these features is shown in U.S. Pat. No. 4,146,775 assigned to the assignee of the present invention.

While the apparatus described above has provided generally satisfactory performance the present invention has resulted from a continuing effort to improve thereon.

It is customary to size the steam generator to at least meet the maximum expected steam output demand that may be encountered in the environment in which it is to work. However, when the demand for steam output is low compared to the maximum capacity of the unit, problems may result in some conventional steam generating humidifiers. In starting out from a cold condition, such a steam generator may tend to overfill and hence, as the water therein comes to a boil between the electrodes, the steam output may greatly exceed the level of steam production required, thereby causing a rapid rise in the humidity of the environment being humidified. If the steam output is very substantially greater than the desired steam output, the humidity level in the environment may rise to an unacceptably high level before the humidifier responds so as to terminate or reduce steam production. The steam output may remain off or at a very low level until the eventual fall in humidity in the environment again calls for opening of the fill valve and an increase in steam output, thus repeating the cycle. This on/off steam output is called "hunting" because the unit hunts for but never finds a steady operation condition. The net result tends to be an ongoing, unintended rise and fall in humidity in the environment.

Even during ongoing operation of the humidifier with the electrodes maintained partially immersed such that water therebetween is being vaporized, admission of cool fresh water to the boiler tank will raise the water level between the electrodes and thus increase electrode current but this may not immediately result in an increase in vapor output, until the freshly admitted fill water reaches the ambient temperature of the existing water in the boiler. Thus there may be some tendency to overshoot in vapor output after that temperature equalization takes place, particularly if the then maximum of electrode current and vapor output is substantially greater than that required to maintain the environmental humidity at the desired level. The typical conventional electrode-type humidifier will thus hunt in steam output repetitively above and below the level required to maintain the desired humidity level, particularly when the steam output required for a desired level of humidity is well below the maximum output capability of the humidifier apparatus.

Accordingly, the objects and purposes of the invention include the provision of:

- a humidifier apparatus capable of automatically adjusting steam output capacity in response to a continuation, for more than a predetermined time, of a preselected humidity demand characteristic;
- an apparatus as aforesaid in which the humidity demand characteristic required for an increase in steam output may be an on/off humidistat remaining on, or a proportional humidistat signal remaining above some established level, for more than a predetermined time and such characteristic can further include an on/off humidistat remaining off, or a proportional humidistat signal remaining below some established level, for more than a predetermined time;
- an apparatus as aforesaid in which the output capacity of the humidifier will remain unchanged if, for example, an on/off humidistat cycles between on and off conditions during a predetermined length of time or if a proportional humidistat signal remains within a predetermined range for a predetermined length of time;
- an apparatus as aforesaid which substantially reduces the tendency of the apparatus to overshoot and undershoot the desired humidity level, i.e. to hunt, particularly where the level of humidity required in the environment requires a steam output considerably below the maximum capability of the humidifier apparatus;
- an apparatus as aforesaid capable of continuous modulated output; and
- an apparatus as aforesaid capable of providing various arrangements for flushing of the water tank to maintain mineral content in the water below a desired level.

Other objects and purposes of the invention will be apparent to persons acquainted with apparatus of this general type upon reading the following description and reviewing the accompanying drawings.

SUMMARY OF THE INVENTION

A vaporizing humidifier includes a portion for providing stepwise increases and decreases in vapor output capacity in response to the duration of a vapor demand signal, for matching the vapor output to the demand therefore.

DETAILED DESCRIPTION

Figure 1:
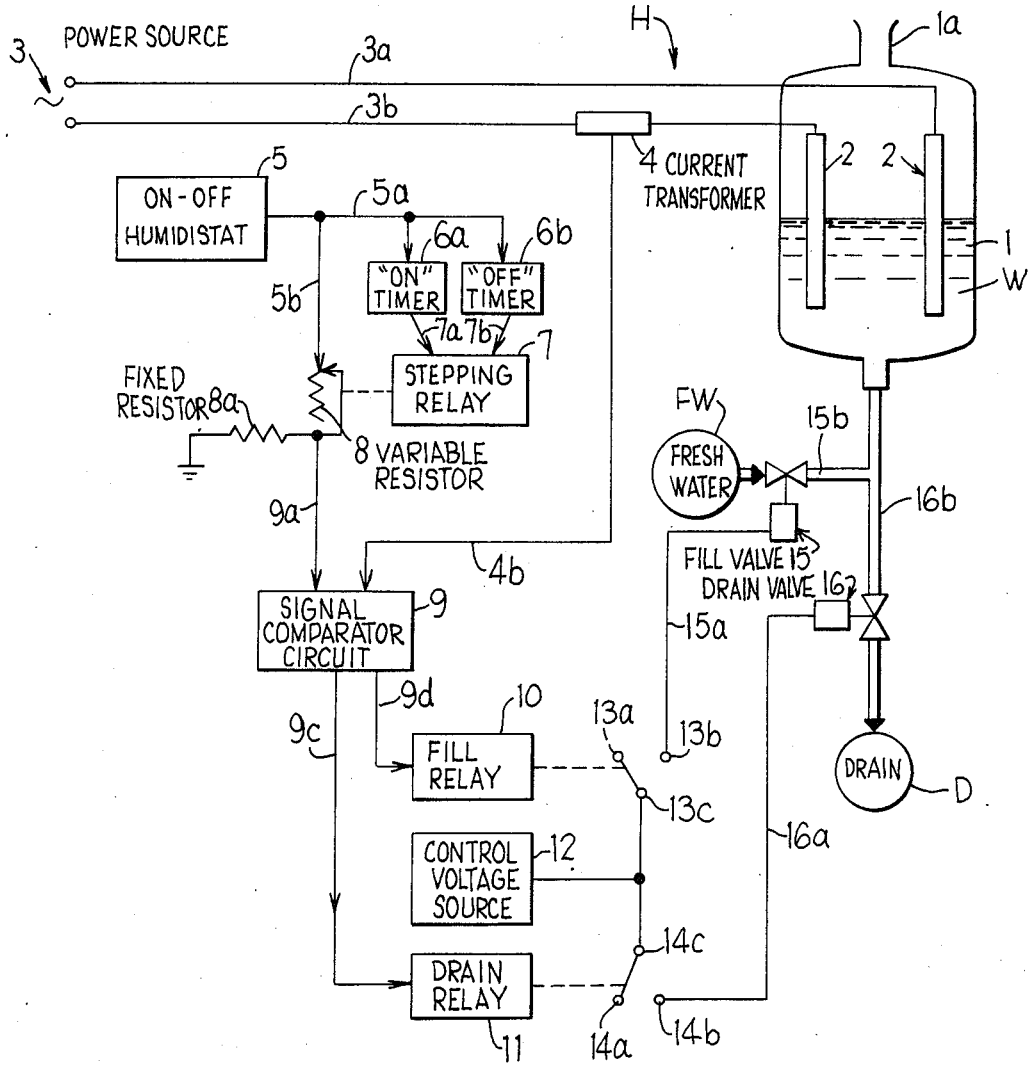
FIG. 1 is a schematic view of a first embodiment of the invention.

Turning to FIG. 1, a humidifier apparatus H comprises a steam generator vessel 1 for water W to be vaporized. The vessel 1 has a vapor outlet 1*a* in the top thereof for releasing water vapor resulting from steam generation therein. A pair of electrodes 2, preferably formed as conductive plates, extend downward into the vessel 1 in spaced side-by-side relation and are preferably spaced somewhat above the bottom wall of the vessel 1. The vessel 1 is preferably made of electrically non-conductive material such as a synthetic resin.

The electrodes 2 receive electric power from a suitable fixed voltage source 3, conveniently a standard AC power circuit to which connection may be made by any convenient means not shown, for example a conventional AC plug and/or switch. More particularly, a pair of electrically conductive leads 3*a* and 3*b* connect to opposite sides of the electrical power source 3. Lead 3*a* connects one side of the power source 3 to one of the electrodes 2. The other lead 3*b* connects the other side of the power source 3 through the primary of a current transformer 4 to the other electrode 2. If desired fuses (not shown) may be interposed in the leads 3*a* and 3*b*.

The secondary winding of the current transformer 4 outputs through a line 9*b* connected as discussed hereafter. A drain conduit 16*b* is connected to the bottom of the vessel 1 and has an electrically controlled valve 16, conveniently a solenoid valve, therein for turning on and off connection of the drain conduit 16*b* to a drain.

A water supply conduit 15*b* connects the vessel 1 to a conventional water supply FW, for example a tap connected to a city water supply or the like, and flow through the conduit 15*b* is controlled by an electrically operated fill valve 15, conveniently a solenoid valve. In the embodiment shown, the fresh water conduit 15*b* also connects to the bottom of the vessel 1, here through a portion of the conduit 16*b*. Opening the fill valve 15 admits fresh water to the vessel 1, diluting the salts concentration of the vessel 1 and raising the level of water in the vessel 1 to increase the immersion of the electrodes 2 and hence the rate of steam output thereby.

The humidifier apparatus H further includes a conventional humidistat 5 which produces an electrical output related to the humidity in the environment (for example, room or the like) to be humidified by the humidifier H.

To the extent above described, the humidifier H is conventional and conforms for example to U.S. Pat. No. 4,146,775 assigned to the assignee of the present invention.

It is convenient to control the fill and drain valves 15 and 16 by means of respective relays, here a conventional fill relay 10 and drain relay 11. A suitable control voltage source 12, appropriate for electrical actuation of the fill and drain valves 15 and 16 connects to movable contacts 13*c* and 14*c* of the fill and drain relays 10 and 11 respectively. In the normal deactuated condition of the fill relay 10, its movable contact 13*c* is at open position 13*a* but actuation of the fill relay 10 shifts movable contact 13*c* to connect same to contact 13*b* and thereby to connect the control voltage source 12 through lead 15*a* to the fill valve 15 for opening the fill valve and flowing water from the fresh water source FW into the vessel 1. Similarly, the drain relay 11 in its normal deactuated condition locates the movable contact 14*c* thereof in its open position 14*a* but actuation of the drain relay 11 causes the movable contact 14*c* thereof to shift to its closed position 14*b* so as to connect the control voltage source 12 through line 16*a* to the drain valve 16, thereby opening the drain valve and draining water from the vessel 1 to drain D. Use of, for example, a drain relay to open a drain valve is conventional, as seen for example in mentioned U.S. Pat. No. 4,146,775.

Attention is now directed to structure more directly involved in the present invention.

The humidistat 5 (FIG. 1), or other on/off demand indicating device, turns on a demand signal (for example a voltage high or logic 1) on leads 5*a* and 5*b* when there is a demand for steam. Humidistat 5 turns off (for example dropping the signal on line 5*a* to a low or logic zero) when there is no demand for steam. A variable resistor 8 and fixed resistor 8*a* connect in series between the humidistat output line 5*b* and circuit ground. A lead 9*a* connects the juncture of resistors 8 and 8*a* to an input of a signal comparator circuit 9. The resistors 8 and 8*a* form a voltage divider network such that the voltage-on lead 9*a* is initially at some small portion of the voltage on lead 5*b*, but can be increased up to the full value of the voltage on the lead 5*b* by adjusting the variable resistor 8. The output signal of the humidistat 5 is also applied through line 5*a* to the input of a self resetting "on" timer 6*a* which measures the duration of time during which the humidistat signal is on.

A stepping relay 7 has a pair of inputs actuable for stepping the relay, and hence the variable resistor 8, in respective opposite directions. If the humidistat signal remains on for more than a predetermined length of time, the "on" timer 6*a* outputs on a lead 7*a* to the stepping relay 7 which causes the stepping relay 7 to change the value of the variable resistor 8 so that the humidistat voltage on the line 9*a* is increased. The "on" timer 6*a* is of a type which resets to zero when the input signal on line 5*a* either has remained on for more than the above-mentioned predetermined length of time, or turns off.

The humidistat output signal on line 5a is also applied to the input of a self resetting "off" timer 6b, which measures the duration of time during which the humidistat signal is off. If the humidistat signal on line 5a remains off for more than a predetermined length of time, the "off" timer 6b outputs on a lead 7b to the stepping relay 7 to cause the stepping relay 7 to change the value of the variable resistor 8 in such direction that the humidistat voltage on the lead 9a is decreased. The "off" timer 6b is arranged so that it will reset to zero when the humidistat signal on lead 5a either has remained off for more than the mentioned pre-determined length of time, or turns on. The timers 6a and 6b and stepping relay 7 are individually conventional.

In one embodiment, the stepping relay 7 stepped the variable resistance 8 to change the modified stat signal on lead 9a in steps of about 20% of the total humidistat "on" signal, namely so that the signal on lead 9a may represent 20%, 40%, 60%, 80% or 100 % of the humidistat 5 "on" output, although different percentage steps and number of steps are contemplated.

The modified stat signal lead 9a and current signal lead 4b connect to respective inputs of a signal comparator circuit 9. It is convenient to compare the DC signal on lead 9a to a DC, rather than AC, signal. Thus, for convenience the output side of the transformer 4 may incorporate a conventional rectifier and filter (not shown) so that the current signal on line 9b is a DC one. The signal comparator circuit 9 has output leads 9c and 9d to the drain relay 11 and fill relay 10 respectively.

Figure 2:
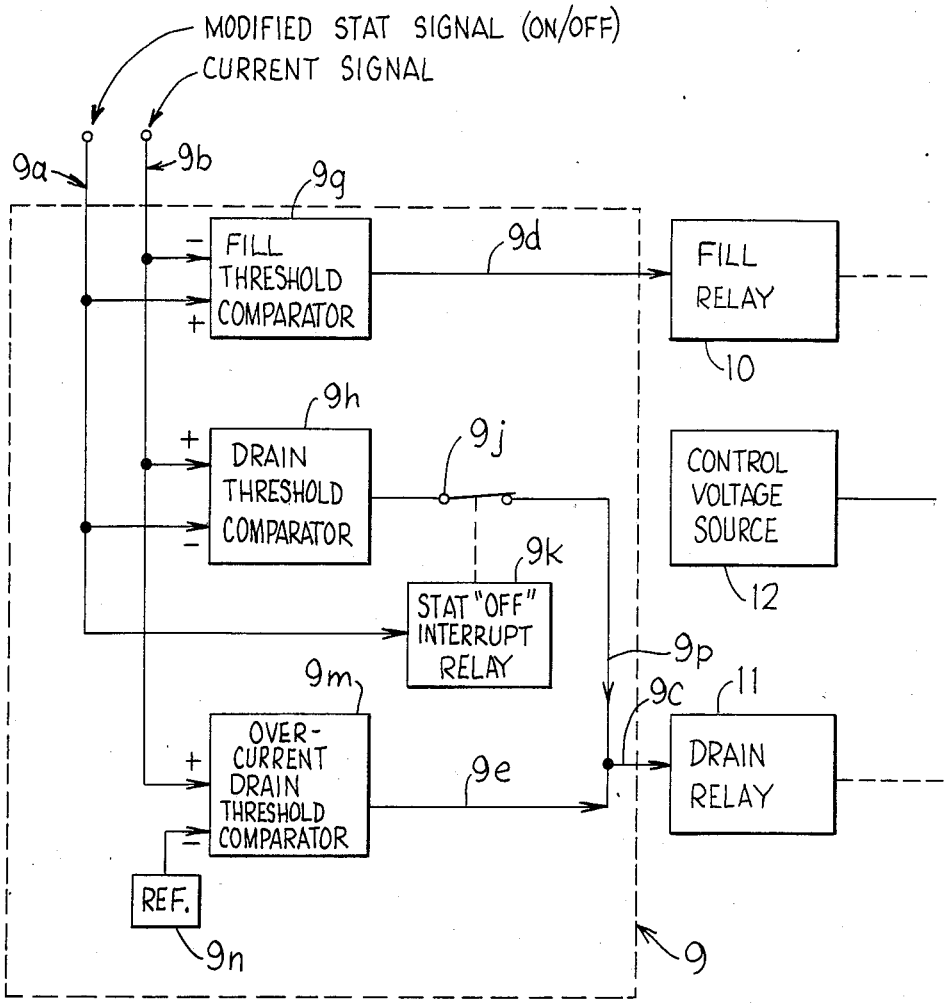
FIG. 2 is a schematic view of a signal comparator circuit usable in the FIG. 1 apparatus.

FIG. 2 shows a preferred signal comparator circuit 9, which comprises a fill threshold comparator 9g, connected at its inputs to the leads 9b and 9a respectively and at its output through the lead 9d to the fill relay 10. A drain threshold comparator 9h has noninverting and inverting inputs respectively connected to the current signal line 9b and modified stat signal line 9a and an output connected, through a normally closed contact 9j of a stat "off" interrupt relay 9k, to the lead 9c to the drain relay 11. The stat "off" interrupt relay 9k is also connected to the modified stat signal line 9a in response to an off condition thereon by opening the contact 9j so as to disconnect the drain threshold comparator 9h from the drain relay 11 when the humidistat 5 is in its off condition.

In the embodiment shown, the comparator circuit 9 preferably also includes an overcurrent drain threshold comparator 9m whose noninverting and inverting inputs are respectively connected to the eurrent signal line 9b and a reference voltage source 9n and which has an output which through a lead 9e connects also to the input of the drain relay 11. The comparators 9g, 9h and 9m may be conventional differential amplifiers which, in a conventional manner are each provided with a feedback path (not shown) for providing hysteresis, such that when the noninverting input rises to a voltage higher than the inverting input, the comparator will produce an output (to actuate the relay to which it is connected) and will maintain such relay actuated until the inverting input rises to somewhat exceed the noninverting input to then deactuate the corresponding relay. It will be understood that the turn on and turn off points for the corresponding relay depend on the relative values on the inverting and noninverting inputs of the comparator such that the effective rise in voltage on one comparator input acts like a fall on the other, and vice versa.

When the humidistat 5 is on and the signal on current signal lead 9b is less than the modified stat "on" signal on lead 9a, the comparator 9g outputs on the lead 9d to actuate the fill relay 10 and thus shift the movable switch contact 13c from its open position 13a to its closed position 13b, thus applying voltage from the control voltage source 12 to the fill valve 15, opening the fill valve 15 and causing fresh water from source FW to flow to the vessel 1, increasing immersion of the electrodes 2, the current through transformer 4 and hence the signal on lead 9b. When the current signal on lead 9b rises to equal the modified stat "on" signal on lead 9a, the fill threshold comparator 9g shuts off the fill valve 15.

Continued boiling away of water normally gradually reduces the water level in the vessel 1, thus gradually reducing electrode current and the current signal on line 9b. The hysteresis of comparator 9g accommodates some drop (for example about 5%) in the signal on lead 9b before it again opens the fill valve 15. Thus, the fill valve 15 will briefly open in a repetitive manner on a relatively frequent basis so as to keep steam output and hence the signal on line 9b within for example 5% of the output called for by the modified stat "on" signal on lead 9a.

In one example the normal "on" timing period $T_n$ of the on timer 6a, was ten minutes, and the "off" timing period of the "off" timer 6b was similarly 10 minutes, although different length periods are contemplated.

During ongoing operation of the apparatus, the fill threshold comparator 9g will normally operate the fill valve much more frequently than will the drain threshold comparator 9h open the drain valve, because boiling away of water and consequent reduction of water level in the vessel 1 will tend to gradually reduce heating current and hence the current signal on line 9b and thus reduce the likelihood of a current signal on line 9b exceeding the modified stat signal on line 9a, the condition required to cause the drain threshold comparator to open the drain valve. However, should for some reason the current signal on lead 9b rise above the modified stat "on" signal on lead 9a by some amount, for example 5%, the drain threshold comparator 9h will output through the closed contact 9j to actuate the drain relay 11 and thus open the drain valve 16 to reduce the water level and heating current level in the vessel 1. When the water level and heating current drop sufficiently for the current signal on line 9b to fall substantially to the voltage on current signal line 9a, the drain threshold comparator 9h deactuates the drain relay 11 and closes the drain valve 16. Such an opening of the drain valve by the drain threshold comparator 9h may occur for example, if the fill valve fails to close completely and continues to leak water into the vessel at a rate to drive up the heating current faster than same is reduced by boil away of water from the tank.

On the other hand if the demand for humidity in the environment is satisfied and the humidistat 5 assumes its "off" condition, the voltage on line 5b and hence on the line 9a drops substantially, for example to zero voltage or near thereto. This triggers both the drain threshold comparator 9h and the stat "off" interrupt relay 9k. The latter opens the contact 9j and prevents the actuated drain threshold comparator from actuating the drain relay 11. This avoids premature draining of water from the tank despite the now radically lower voltage on modified humidistat output line 9a than on current signal line 9b.

Normally, continued boil off of water from the vessel 1 will gradually reduce the heating current and hence the voltage on current signal line 9b. This will gradually lower the steam output and thus tend to lower humidity in the environment being served and eventually tend to again turn on the humidistat 5. When the humidistat 5 again turns on, the voltage on the line 9a rises to the fraction of the humidistat "on" voltage set by the voltage divider 8, 8a, which depends on the then existing position of the stepping relay 7. Appearance of a fraction of the humidistat "on" voltage on line 9a causes the interrupt relay 9k to again close the contact 9j and connect the output of the main threshold comparator 9h to the relay 11. Depending on the then relationship of the voltage as appearing on lines 9a and 9b the drain threshold comparator 9h may or may not actuate the drain relay 11 and hence open the drain valve.

The overcurrent drain threshold comparator 9m is here provided to avoid a rise in heating current to beyond a preselected allowable maximum, corresponding to the voltage level preset by the reference 9n, by triggering the drain relay 11 through the lead 9e for opening the drain valve, thus reducing the water level on the vessel and thus reducing the level of heating current to below the level corresponding to the reference 9n. The overcurrent drain threshold comparator 9m thus can be used to keep heating current below a desired safe maximum under a unusual conditions, such as a failure of the drain threshold comparator to actuate the drain relay 11 when desired, a failure of the fill valve to shut off properly or these factors combined with excessive salts concentration and hence water conductivity in the vessel 1, leading to a heating current greater than the designed maximum for the apparatus.

Separate conventional means, not shown, may be provided to open the drain valve 16 and discharge a desired amount of the water in the vessel 1, to maintain mineral concentration of the water in the vessel 1 below a desired level, for example in response to demand by a timer (e.g. every two hours) or a water conductivity monitor.

The operation of the apparatus is summarized below by reference to FIG. 3 which shows a typical operating sequence from start-up. The water level in vessel 1 is below or nearly below the electrodes 2 so heating current is very low as is the current signal on line 9b. At time $T_O$ when the humidifier is turned on the stepping relay 7 is at its 20% position (see FIG. 3 part A). Assuming the humidistat is "on", the modified stat signal on line 9a is greater than the current signal on lead 9b, thus actuating the fill threshold comparator 9g and fill relay 10 and hence opening the fill valve at time $T_O$. As seen at parts C and D of FIG. 3, the fill valve stays open (filling) for the initial portion of the first "on" interval $T_n$, causing the voltage on heating current signal line 9b to rise at 9b-1 to the 20% humidistat level represented by the then voltage on modified humidistat "on" lead 9a. While the "on" timer 6a continues to time its first interval $T_n$, the fill threshold comparator 9g responds to successive small reductions in water level and heating current due to water boil away from the vessel 1 by repetitively opening for short times the fill valve of 15, at 9b-2. At time $T_1$, the end of the first "on" interval timed by timer 6a, the humidistat 5 is still on (calling for more steam), the "on" timer 6a times out and steps up the stepping relay 7 to increase the voltage on lead 9a to the 40% level (see part C of FIG. 3). Accordingly, the fill threshold comparator 9g again opens the fill valve to increase vessel water level and hence heating current signal at 9b-3 and the second "on" interval $T_n$ is timed with the fill threshold comparator 9g again briefly repetitively opening the fill valve 15 as needed to maintain the heating current signal on lead 9b at about the same voltage level as appearing on line 9a at the 40% level of humidistat "on" output.

Figure 3:
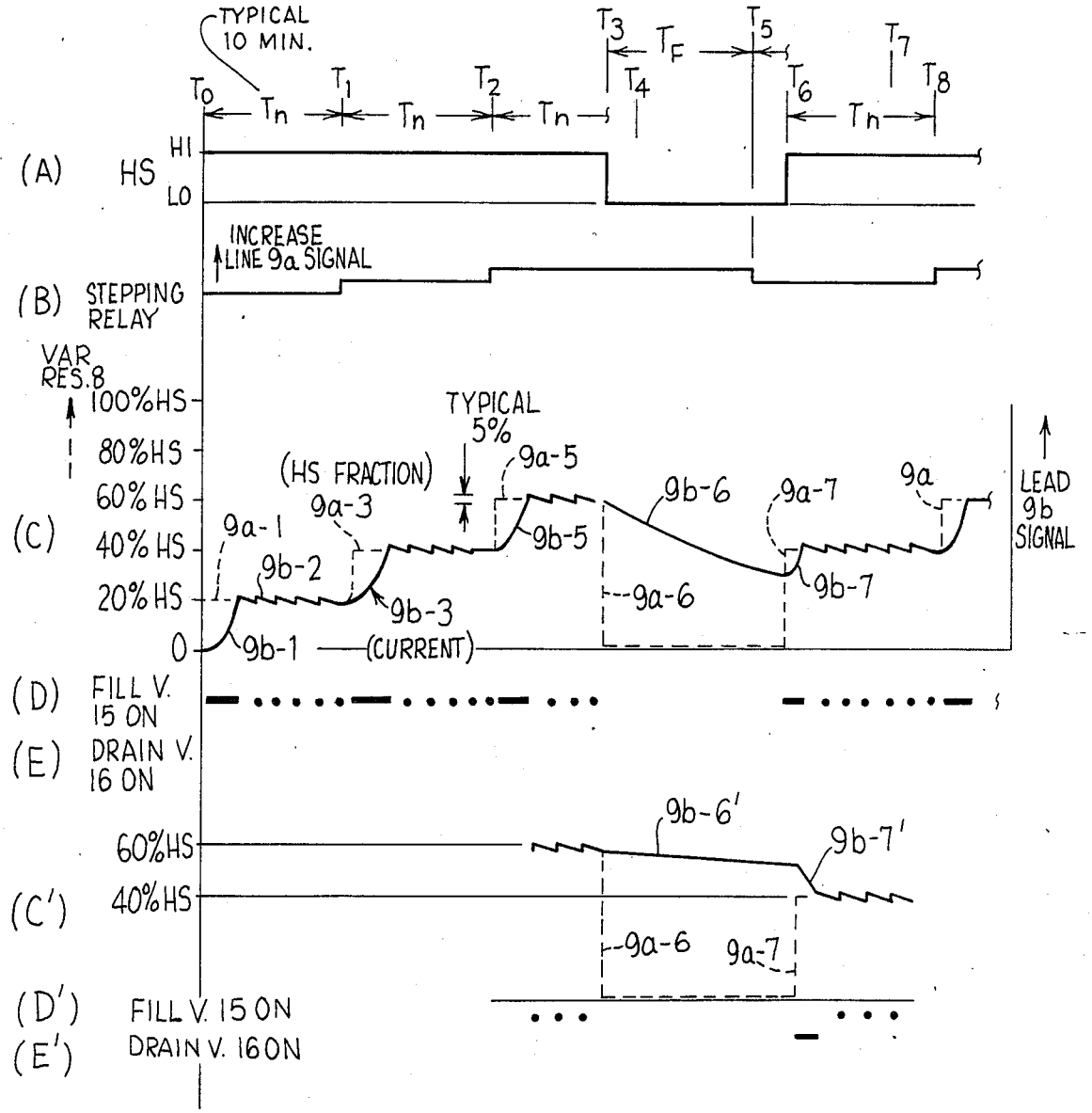
FIG. 3 is a waveform diagram illustrating the humidistat signal and actual steam output of an apparatus according to FIG. 1.

If the humidistat is still "on" at time $T_2$, the timing out of the "on timer" 6a at the end of its second interval $t_n$ steps the stepping relay 7 up again, now to the 60% of humidistat "on" level, so that the fill threshold comparator 9g again opens fill valve 15 to increase the heating current and current signal on line 9b (compare curves 9a-5 and 9b-5 in part C of FIG. 3).

Assume that for some reason the humidistat 5 turns off at time $T_3$. The "on" timer 6a is thus shut off and the "off" timer 6b initiates timing of an "off" interval $t_f$. The signal on lead 9a, since it is a fraction of the humidistat output on line 5b, goes very low or essentially to zero as seen at 9a-6. Typically, water level and conductivity and hence heating current all decline during interval $T_f$ due to boil off of water from the vessel 1, resulting in a gradual decrease of the current signal on line 9b, as at 9b-6. At the end $T_5$ of the first "off" interval $T_f$, timing out of the "off" timer 6b steps down the stepping relay 7, here from the 60% to the 40% humidistat output level (see part B of FIG. 3). The continued off condition of the humidistat 5 causes the "off" timer 6b to start timing a second "off" interval.

However, in the example shown, it is assumed that the humidistat, for some reason, turns on again part way through the second "off" interval and before such interval would end at time $T_7$. This turn on of humidistat 5 appears at time $T_6$ and causes the voltage on line 9a to jump to the 40% level dictated by the switching relay 7, as indicated at line 9a-7. More specifically, in the example shown, the heating current and hence the signal on line 9b has fallen along the curve 9b-6 to below the 40% humidistat output level. Accordingly, at a time $T_6$ the rise 9a-7 on the modified humidistat "on" lead 9a makes it greater than the then voltage on line 9b, causing the fill threshold comparator 6g to open the fill valve 15 to again raise vessel water level, heating current level, and (as indicated at 9b-7) the current signal on line 9b to correspond to the 40% level signal on line 9a.

The sequence illustrated in part C of FIG. 3 may then continue as dictated by the condition of the humidistat.

A further example is shown in FIG. 3 parts C'–E' which differs from the example discussed above in that at time $T_3$, for some reason, the heating current and hence current signal on line 9b may fail to fall or may rise or in the particular example shown falls only very slowly, as illustrated by the curve 9b-6'. Accordingly, at time $T_6$ the signal on line 9b is above that on line 9a. Consequently at time $T_6$ it is the drain threshold comparator 9h which is actuated. This opens the drain valve 16 until sufficient water is drained from the vessel 1 to drop the heating current, and hence current signal on line 9b along the path 9b-7' to the 40% level of humidistat output whereupon the-drain valve closes. The operation shown in FIG. 3 in lines C', D' and E' is a possible, though in actual operation, unlikely sequence.

While a substantial number of examples of operation of the apparatus of FIGS. 1 and 2 may be illustrated, it is believed that the two examples given in FIG. 3 will serve to illustrate various operating conditions of the apparatus.

MODIFICATION (FIGS. 4, 5, 5A)

Figure 4:
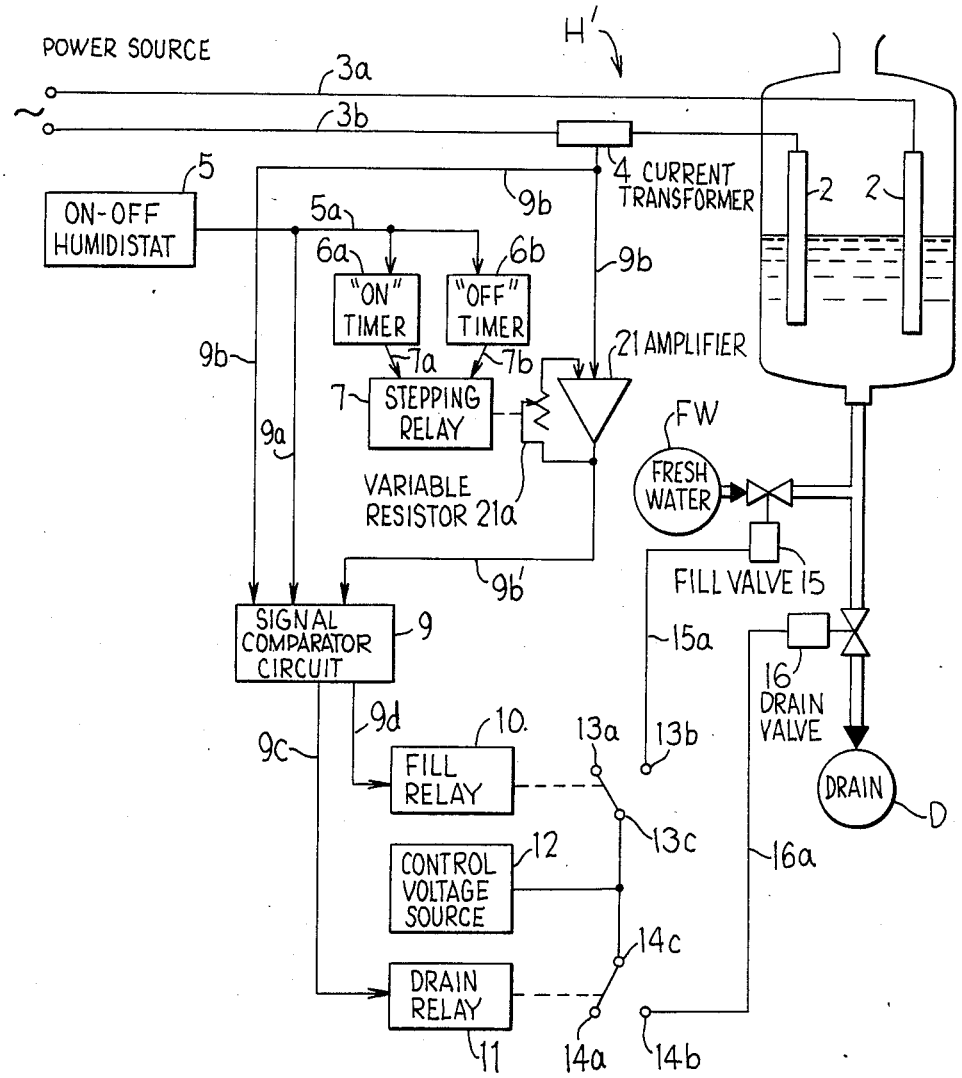
FIG. 4 schematically illustrates a second embodiment of the invention.
Figure 5:
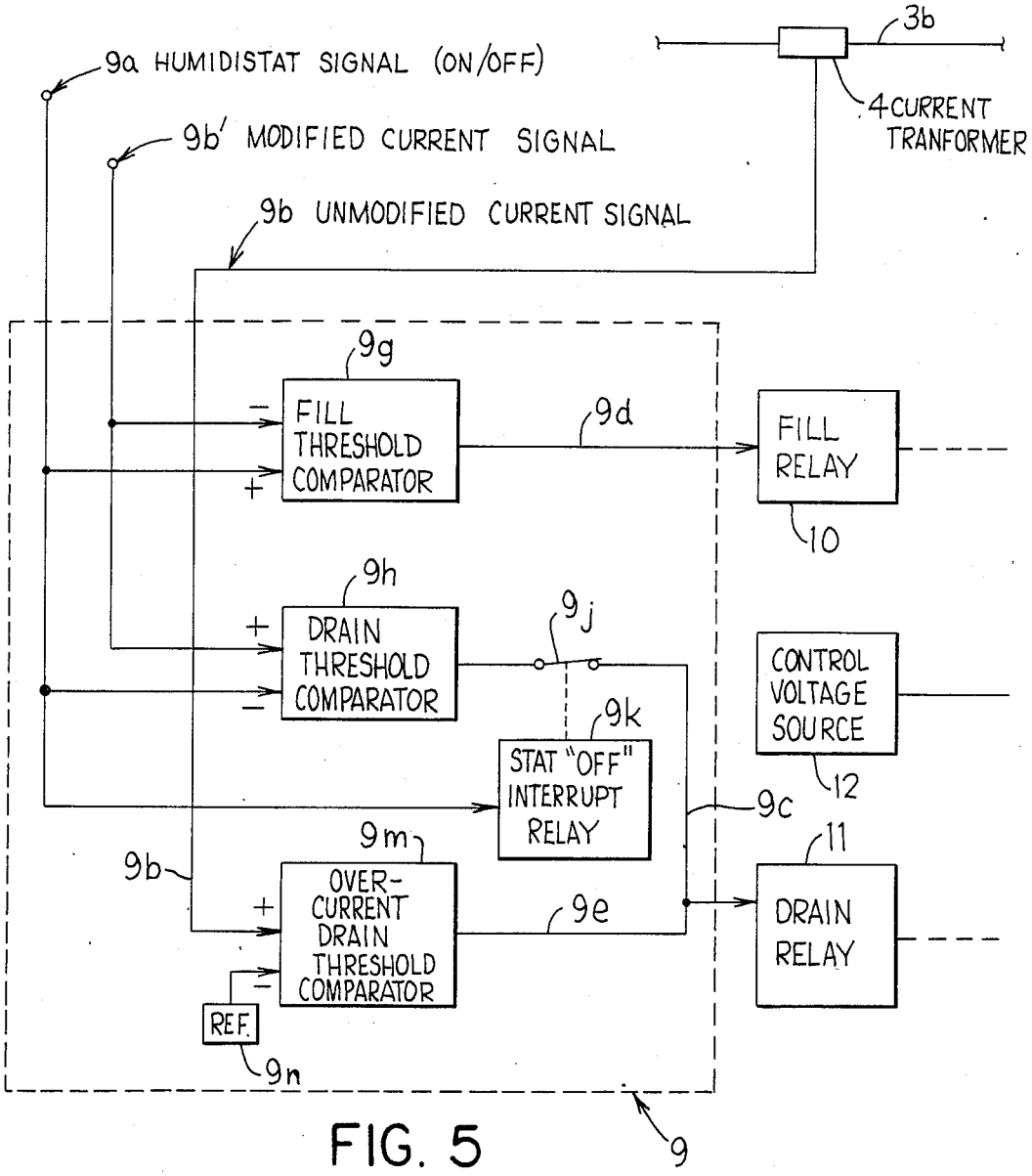
FIG. 5 is a schematic view of a signal comparator useable in the FIG. 4 apparatus.

FIG. 4 shows a modified embodiment H'. In FIGS. 4 and 5 parts corresponding to parts in FIGS. 1 and 2 carry the same reference numerals and require no further description.

The modified apparatus H' of FIGS. 4 and 5 differs from apparatus H above described with respect to FIGS. 1-3 as follows. In FIG. 4 the output line 5*a* of the on-off humidistat 5 connects directly through the lead 9*a* to the signal comparator 9. Instead of a voltage divider 8, 8*a*, the stepping relay 7 instead steps the setting of a variable resistor 21*a* connected in the usual feedback loop of an operational amplifier 21 to change the gain thereof. The operational amplifier 21 is interposed in the line 9*b* from the current transformer 4 to the signal comparator 9. The lead running from the amplifier 21 to the signal comparator 9 is thus labeled 9*b'* and is referred to as the modified current signal lead. In FIG. 5 it is the modified current signal lead 9*b'* that connects to the respective inputs of the fill threshold comparator 9*g* and drain threshold comparator 9*h*, rather than the unmodified current signal line 9*b*.

The operational amplifier 21 receives the unmodified current signal from the current transformer 4 on input line 9*b*, multiplies that unmodified current signal by a factor directly proportional to the value of the variable resistor 21*a* and sends the resultant amplified signal to the signal comparator 9 as the modified current signal on line 9*b'*, which modified current signal is applied to the current signal inputs of the fill threshold comparator 9*g* and drain threshold comparator 9*h* which then operate substantially in the manner discussed above with respect to FIGS. 1-3.

Figure 5A:
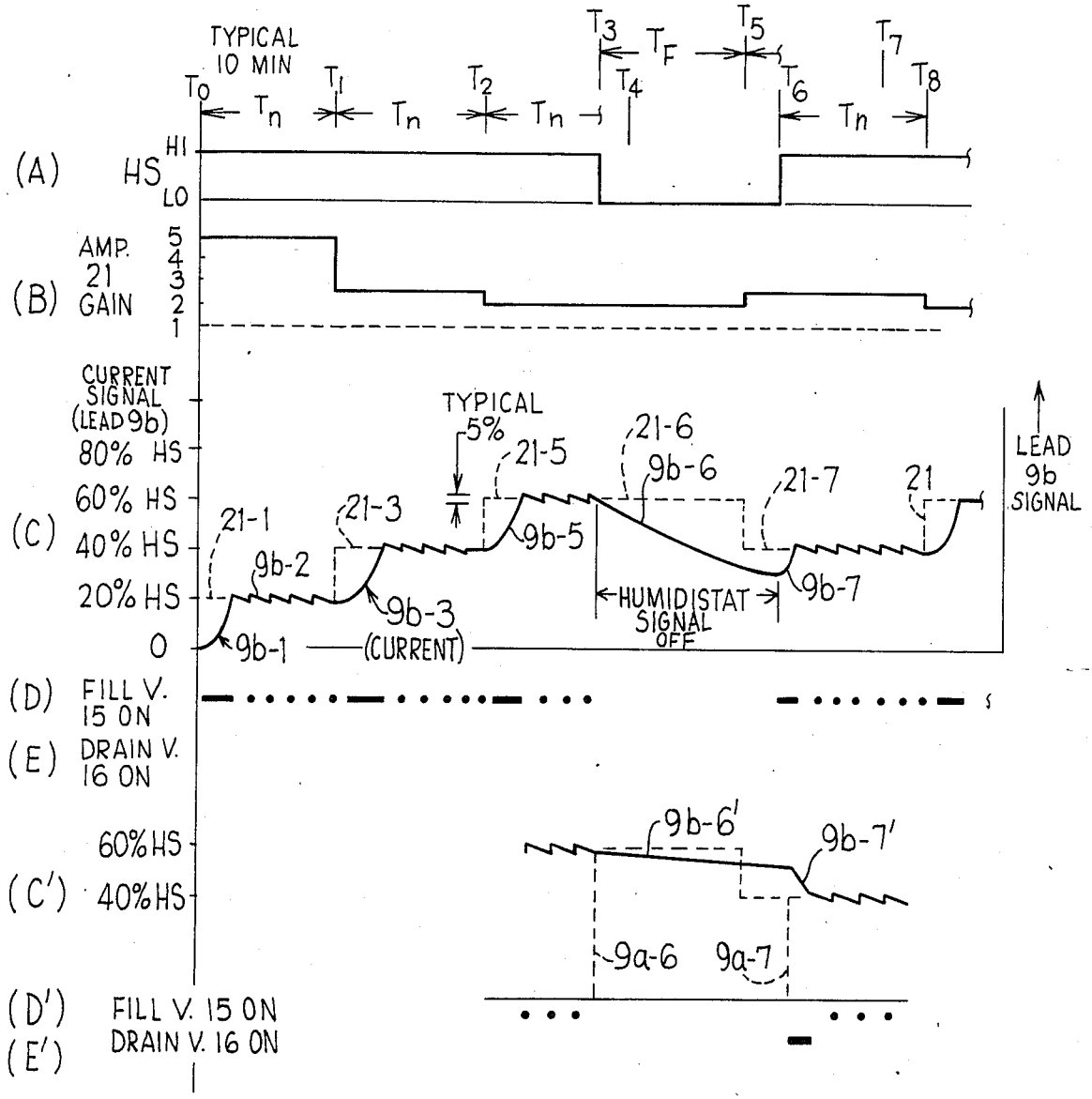
FIG. 5A is a waveform diagram illustrating the humidistat signal and actual steam output of an apparatus according to FIG. 4.

FIG. 5A illustrates the operation of the FIGS. 4 and 5 embodiment. Part A-E of FIG. 5A is much like the corresponding parts of FIG. 3 above discussed, except that in part B the leftward vertical scale designation shows the gain on amplifier 21. Furthermore, the corresponding dotted line in part C is the reciprocal of the gain on amplifier 21, and thus represents a desired upper limit on the lead 9*b* signal, and hence on the current flow to the steam generator. The solid line represents the unmodified current signal on line 9*b*. The operation is otherwise similar.

Thus, if the signal on line 9*a* from the humidistat 5 remains on for a predetermined time period $T_n$, the "on" timer 6*a* times out and causes the stepping relay 7 to decrease the variable resistance 21*a*, thus decreasing the gain of the amplifier 21 and reducing the percentage of the lead 9*b* current signal appearing on modified current signal lead 9*b'*, for example from 500% to 250% This causes the fill threshold comparator 9*g* to open the fill valve, and to increase the water level, the heating current, and hence the unmodified current signal on line 9*b* until the modified current signal on line 9*b'* corresponds to the humidistat signal on line 9*a*. This is illustrated by the curve portions 9*b*-1 and 21-1 in FIG. 5A part C. It can be seen from FIG. 5A that the operation of the FIGS. 4 and 5 apparatus H' is similar to that of the FIGS. 1 and 2 apparatus H in terms of the response of the threshold comparators to the changing of values at their inputs.

On the other hand, if the signal from the humidistat on line 9*a* remains off for a time period $T_f$ the "off" timer 6*b* causes the stepping relay 7 to increase the resistance 21*a*, thus increasing the gain of the amplifier 21. In fact, from the time $T_3$ through the timed humidistat off period $T_f$ to time $T_5$ and beyond is seen in FIG. 5A to have substantially the same effect as in the corresponding part of FIG. 3, with respect to the vessel water level, heating current and unmodified current signal on line 9*b*, as seen at 9*b*-6 and 9*b*-7. During this interval from time $T_3$ to time $T_6$, the limiting value of the current signal, represented by the dotted line 21-6, remains flat at the 60% level until time $T_5$ and then changes to the 40% level as indicated at 21-7. However, the humidistat signal is off from time $T_3$ to time $T_6$ such that the stat "off" interrupt relay 9*k* opens its contact 9*j* and prevents the drain threshold comparator 9*h* from opening the drain relay 11 during that interval, just as in the embodiment of FIGS. 1-3.

The FIGS. 4 and 5 apparatus H' provides to the signal comparator 9 higher signal levels (due to the use of the amplifier 21 in FIG. 4 rather than the voltage divider 8, 8*a* in FIG. 1). Hence the FIG. 4 embodiment H' is preferred over the FIG. 1 embodiment H.

MODIFICATION (FIGS. 6, 7, 8, 8A)

Figure 6:
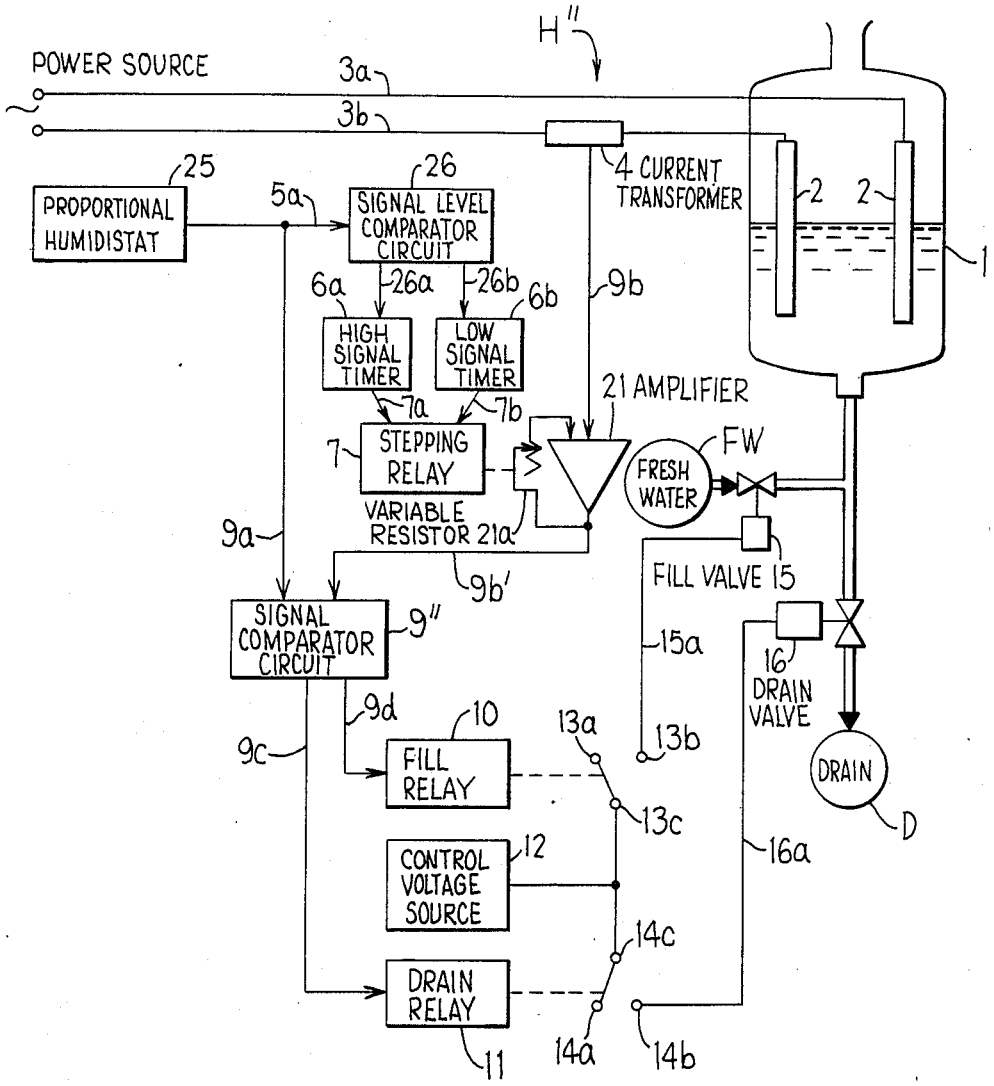
FIG. 6 schematically illustrates a third embodiment of the invention.
Figure 7:
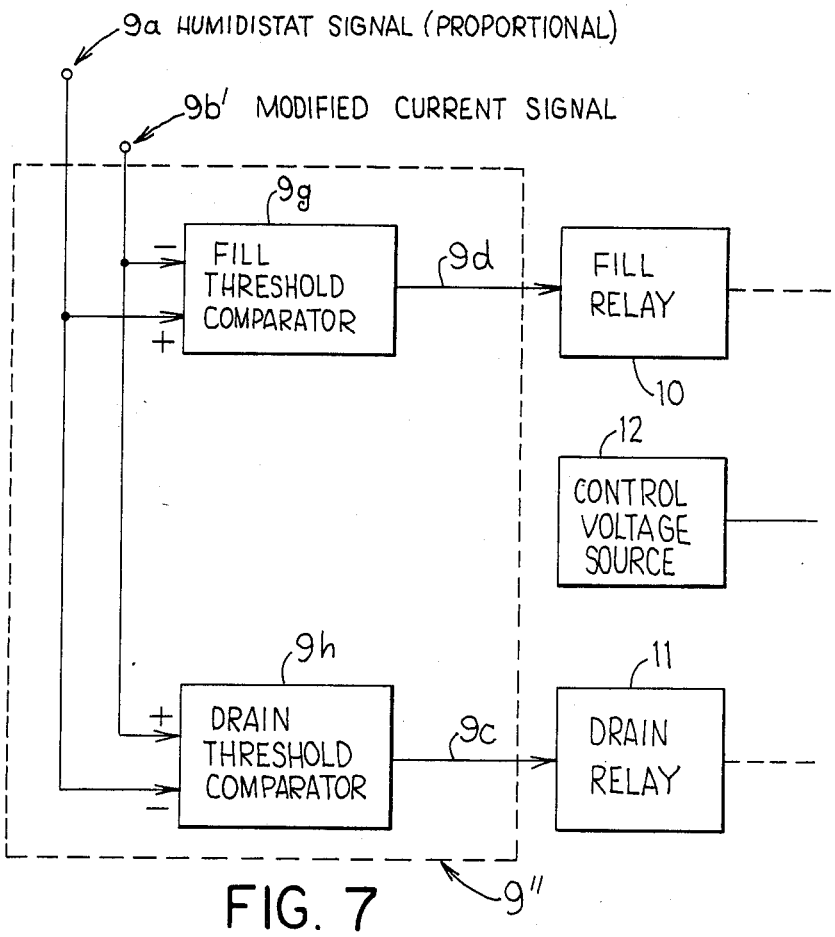
FIG. 7 is a schematic view of a signal comparator circuit usable in the FIG. 6 apparatus.

FIGS. 6 and 7 disclose a further modified humidifier apparatus H". Parts of the FIGS. 6 and 7 apparatus similar to parts of the FIGS. 1 and 2 and FIGS. 4 and 5 apparatus carry the same reference characters, operate in a similar manner and require no further discussion.

The FIG. 6 apparatus H" differs in employing a proportional humidistat, or other proportional demand-indicating device, 25. The output of the proportional device 25 differs from that of the on/off humidistat 5 in that it does not switch between discreet on and off states (high and substantially zero voltage outputs) but rather simply gradually increases or decreases its voltage output in response to increasing or decreasing demand for humidity in the monitored environment. In view of this gradually changing characteristic of the output of proportional device 25, the signal comparator circuit 9" of FIGS. 6 and 7 omits the stat "off" interrupt relay 9*k* and its contact 9*j*, instead directly connecting the out.put of the threshold comparator 9*h* to the drain relay 11. Further, the FIG. 7 comparator circuit 9" omits the overcurrent drain threshold comparator 9*m*. Further, interposed between the humidistat output line 5*a* and the input to each of the timers 6*a* and 6*b* is a signal level comparator 26. In FIG. 6, the timers 6*a* and 6*b* are more logically referred to as high and low signal timers.

When the humidistat signal on line 5*a* is above a high threshold level, equal for example to 75% of the maximum possible humidistat output on line 5*a*, the comparator circuit 26 produces an output on line 26*d* which starts timing by the high signal timer 6*a*. Upon timing out, the high signal timer 6*a* actuates the stepping relay 7 as discussed above with respect to FIG. 4.

On the other hand, when the humidistat signal on line 5*a* is below a low threshold voltage, for example about 25% of the maximum possible humidistat signal on line 5*a*, the comparator circuit 26 provides an output on its line 26*b* to cause timing by the low signal timer 6*b*. When eventually the low signal timer completes timing of its interval, it outputs on line 7*b* to cause the stepping relay 7 to step in the opposite direction, again as discussed above with respect to FIG. 4.

It will be noted that if the humidistat output on line 5*a* is between the high and low threshold values, then the signal level comparator circuit 26 does not activate either timer 6*a* or 6*b*. As in the preceding embodiments, the timers 6*a* and 6*b* reset themselves if the timing initiation signal on their corresponding input lines 26*a* and 26*b* shuts off, indicating that the humidistat output on line 5*a* is in the middle portion of its range, namely between the high and low thresholds.

Figure 8:
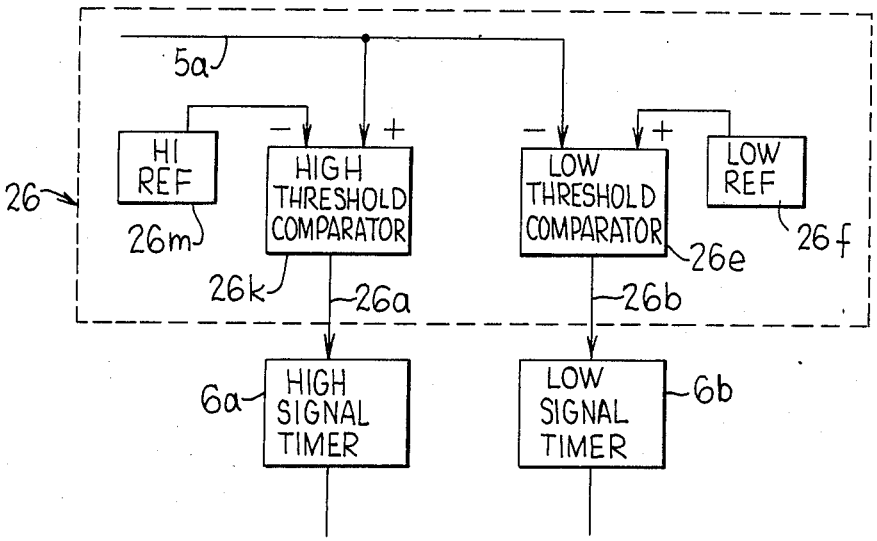
FIG. 8 is a schematic view of a signal level comparator circuit usable in the FIG. 6 apparatus.

FIG. 8 shows one embodiment of the comparator circuit 26, comprising a high threshold comparator 26*k* with inputs connected respectively to the comparator output line 5*a* and a high reference voltage source 26*m*, and a low threshold comparator 26*e* with inputs respectively connected to the humidistat output line 5*a* and a low reference voltage source 26*f*, the outputs of the high and low threshold comparators connecting through the leads 26*a* and 26*b* to the respective high and low signal timers 6*a* and 6*d*. The high and low reference voltage sources 26*m* and 26*f* respectively output voltages of for example 75% and 25%, respectively, of the maximum output of the humidistat 25.

Figure 9:
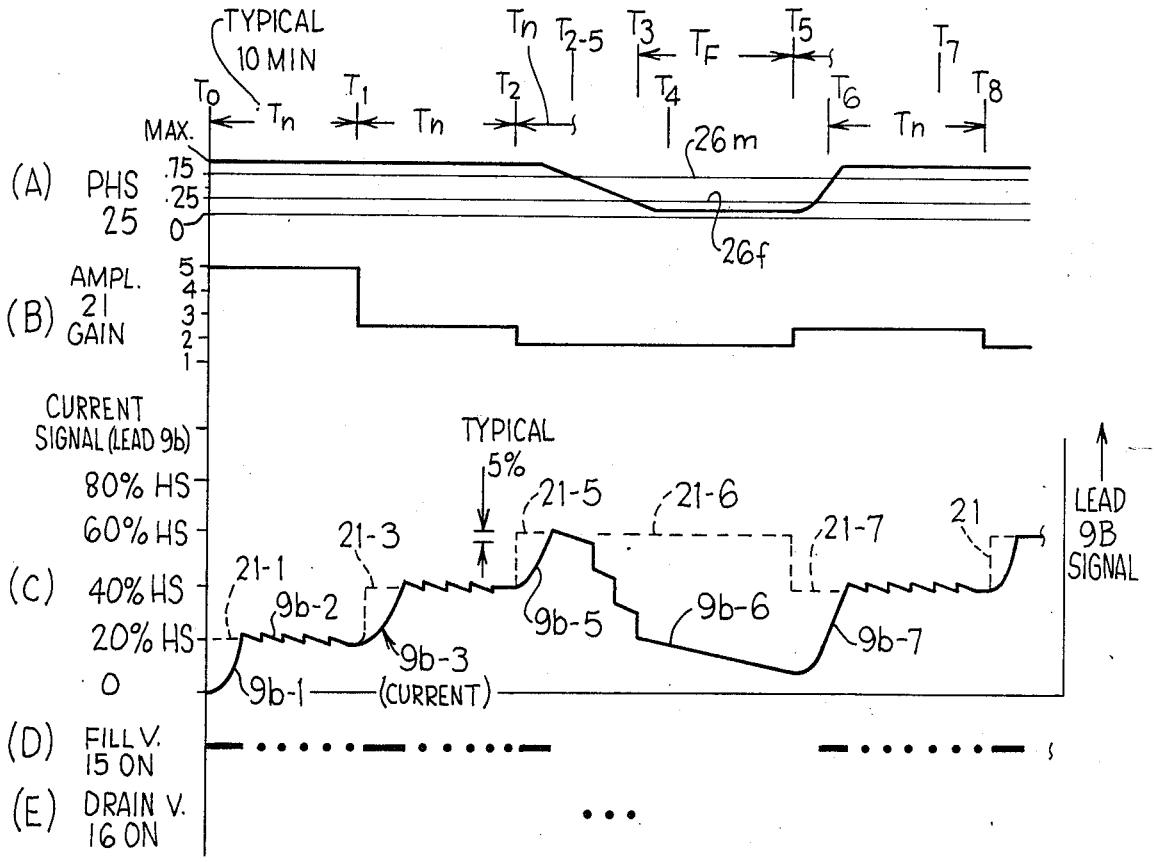
FIG. 9 is a waveform diagram illustrating the humidistat signal and steam output capacity of an apparatus according to FIG. 6.

In the example of operation shown in FIG. 9, the humidistat 25, much as described above as to the embodiments of FIGS. 1 and 4, calls for more steam for several timing periods $T_n$ of the high signal timer 6*a*, namely through and somewhat beyond time $T_2$, resulting in several shifts by the stepping relay 7 of the variable resistor 21*a*, to decrease amplifier gain as seen in FIG. 9 parts A and B. The stepping of the gain of amplifier 21 steps down the modified current signal on line 9*b*′ and thus actuates the fill threshold comparator 9*g* to open the fill valve 15 and increase the water level in vessel 1 immediately after times $T_0$, $T_1$ and $T_2$, as indicated at 9*b*-1, 9*b*-3 and 9*b*-5, namely until the current signal on line 9*b* has risen sufficient to overcome the reduction in gain in the amplifier 21, such that the modified current signal on line 9*b*′ is again in equilibrium with the humidistat signal on line 9*a*.

In the FIG. 9 example, at some time after time $T_2$, the output of the proportional humidistat 25 is shown to fall, for some reason, dropping past the high threshold (e.g. 75% of maximum humidistat output) at time $T_{2.5}$, which resets the high signal timer 6*a* to zero count. Thus, neither of the high and low signal timers 6*a* are timing. Hence the stepping relay 7 and amplifier 21 gain remain unchanged. This state remains as long as the humidistat 25 output is in the range between the high and low thresholds (for example between 25% and 75% of maximum). Once the vessel is filled to a level corresponding to the humidistat 25 output, only relatively minor changes in the relationship of the signals on line 9*b*′ and 9*a* will usually occur. The usual kind of gradual change to occur is a gradual drop in the modified current signal on line 9*b*′due to boil away of water from the vessel and corresponding reduction in heating current which, if sufficient, will briefly actuate the fill threshold comparator 9*g* and briefly open the fill valve to add make up water to the vessel 1, as at 9*b*-2.

However, a more radical change in the relationship of the signals on lines 9*a* and 9*b*′ may alter the situation. For example, at FIG. 9 part A, if the humidistat 25 output rate of drop differs enough from the normal drop of the modified current signal on line 9*b*′ due to boil off of water from the vessel 1, one or the other of the threshold comparators 9*g* and 9*h* will momentarily actuate its corresponding fill or drain valve, as shown by 9*b*-6, to reduce this disparity.

As the humidistat signal drops (at time $T_{2.5}$) below the high threshold into the midrange of humidistat 25, the high threshold comparator 26*k* shuts off the high signal timer 6*a*. The low signal timer 6*b* already being off, neither timer 6*a* or 6*b* can actuate the stepping relay 7 or change the gain of the amplifier 21.

If the humidistat output falls (as shown at time $T_3$) below the low threshold (e.g. 25% of maximum humidistat output), the low threshold comparator 26 causes the low signal timer 6*b* to start timing. This continues as long as humidistat output on line 5*a* stays below the low (e.g. 25%) threshold. If the latter condition continues long enough, the low signal timer 6*b* times out at the end of its period $T_f$, namely at time $T_5$, whereupon it causes the stepping relay 7 to step the variable resistor 21*a* and change the gain of amplifier 21 in a reverse direction, namely to increase gain so that a smaller electrode current provides a modified current signal on line 9*b*′ capable of balancing the lowering humidistat signal on line 9*a*. This assists stabilizing of the water level and hence current signal at the new level called for by the proportional humidistat 25. At some later time, for example slightly after time $T_5$, should the humidistat output for some reason rise appreciably, the disparity between the signals on line 9*a* and 9*b*′ will again cause the fill threshold comparator 9*g* to open the fill valve and hence raise the water level in the vessel 1, for example as seen at 9*b*-7 in FIG. 9 part C.

While the timers 6*a* and 6*b*, stepping relay 7, comparison circuit 9 and related parts in the above disclosed three embodiments are shown as discreet hardware, it is contemplated that same may be replaced by a conventional microprocessor with appropriate software to carryout the functions above set forth.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A vaporizing humidifier, comprising:

vapor output capacity altering means actuable for gradually increasing and decreasing the vapor output of said humidifier in stepwise increments;

means providing a vapor output signal indicating the instantaneous vapor output of said humidifier;

means providing a demand signal indicating the instantaneous demand for vapor;

signal modifiying means and timing means responsive to a demand signal remaining outside preset limits for more than a preset time interval for causing said signal modifying means to modify the value of one of said demand signal and vapor output signal in a direction to tend to match humidifier capacity to vapor demand; and comparison means responsive to a significant disparity between said modified signal and the unmodified one of said demand and capacity signals for causing said vapor capacity altering means to alter the vapor output capacity of said humidifier in a direction to reduce said disparity, such that said humidifier runs at full capacity only when demand is relatively high but acts like a selected one of several progressively smaller capacity humidifers when demand is substantially lower for at least a preset time interval.

2. The apparatus of claim 1 which said humidifier includes a bath and means for producing humidifying vapor from said bath, said vapor output capacity altering means including fill means actuable for increasing said vapor output by adding water to said bath and drain means actuable for reducing said vapor output by drawing water from said bath, said comparison means including drain threshold comparator means responsive to a significant disparity between said modified signal and the unmodified one of said demand and capacity signals for actuating said drain means.

3. The apparatus of claim 2 in which said comparison means further includes an over current drain threshold comparator responsive to a significant disparity between said capacity signal and a reference signal for also actuating said drain means.

4. The apparatus of claim 1 in which said signal modifying means includes stepping means for stepping up and down the value of said one signal by a fraction of the maximum permitted value of said one signal, such that said value can advance from minimum to maximum only in several steps requiring at least a time period corresponding to several said preset time intervals sequentially timed by said timing means, and such that in starting the humidifier from an inopeative condition the capacity of the humidifier is increased in corresponding steps over a corresponding number of said preset time intervals until humidifier capacity substantially matches demand for vapor output.

5. A vaporizing humidifier, comprising:

vapor output capacity altering means actuable for gradually increasing and decreasing the vapor output of said humidifier;

means providing a vapor output signal indicating the instantaneous vapor output of said humidifier;

means providing a demand signal indicating the instantaneous demand for vapor;

timing means responsive to a demand signal remaining outside preset limits for more than a preset time interval for modifying one of said demand signal and vapor output signal in a direction to tend to match humidifier capacity to vapor demand; and comparison means responsive to a significant disparity between said modified signal and the unmodified one of said demand and capacity signals for causing said vapor capacity altering means to alter the vapor output capacity of said humidifier in a direction to reduce said disparity, in which said timing means comprises first and second timer means respectively responsive to high and low values of said demand signal for timing respective said preset intervals, and signal modifying means responsive to timing out of one of said first and second timer means for carrying out said modification in one direction of one of said vapor output and demand signals and responsive to timing out of the other of said first and second timer means for carrying out modification in the other direction of one of said capacity and demand signals, to tend to match said humdifier capacity to said vapor demand.

6. The apparatus of claim 5, in which said means responsive to timing out is a stepping relay actuable for modifying one of said vapor output and demand signal.

7. The apparatus of claim 6, in which said means responsive to timing out include a resistor voltage divider interposed between said means providing a demand signal and said comparison means and including a part adjustable in responsive to stepping of said stepping relay for varying the fraction of the demand signal applied to said comparison means.

8. The apparatus of claim 6, in which said means responsive to timing out include an amplifier interposed between said means for providing a vapor output signal and said comparison means for applying an amplified version of said vapor output signal to said comparison means, and means for varying the gain of said amplifier in direct relation to the direction of stepping of said stepping relay.

9. The apparatus of claim 6, in which the stepping relay has upstepping and downstepping inputs, one of said inputs being connected to said first timer means and the other being connected to said second timer means.

10. The apparatus of claim 5, in which said comparison means comprises fill threshold comparator means receiving said modified signal and unmodified signal and responsive to a disparity therebetween indicating a demand for more vapor for producing an output, and a fill valve responsive to said output from said fill threshold comparison means for supplying water to said humidifier.

11. The apparatus of claim 5, in which said comparison means includes drain threshold comparison means responsive to a disparity between said demand and vapor output signals indicating excessive vapor output, and drain valve means responsive to said comparison means for draining water from said humidifier.

12. A vaporizing humidifier, comprising:

vapor output capacity altering means actuable for gradually increasing and decreasing the vapor output of said humidifier;

means providing a vapor output signal indicating the instantaneous vapor output of said humidifier;

means providing a demand signal indicating the instantaneous demand for vapor;

timing means responsive to a demand signal remaining outside preset limits for more than a preset time interval for modifying one of said demand signal and vapor output signal in a direction to tend to match humidifier capacity to vapor demand; and comparison means responsive to a significant disparity between said modified signal and the unmodified one of said demand and capacity signals for causing said vapor capacity altering means to alter the vapor output capacity of said humidifier in a direction to reduce said disparity, in which said humidifier comprises at least a pair of substantially vertical electrodes spaced horizontally in a water containing vessel and responsive to electric current flow therebetween for boiling water therebetween and thereby producing vapor, said vapor output signal being representative of the electric current flow between said electrodes, said means providing said demand signal being a humidistat, said timing means including means for modifiying one of said humidistat output signal and electrode current signal.

13. A vaporizing humidifier, comprising:

vapor output capacity altering means actuable for gradually increasing and decreasing the vapor output of said humidifier;

means providing a vapor output signal indicating the instantaneous vapor output of said humidifier;

means providing a demand signal indicating the instantaneous demand for vapor;

timing means responsive to a demand signal remaining outside preset limits for more than a preset time interval for modifying one of said demand signal and vapor output signal in a direction to tend to match humidifier capacity to vapor demand; and comparison means responsive to a significant disparity between said modified signal and the unmodified one of said demand and capacity signals for causing said vapor capacity altering means to alter the vapor output capacity of said humidifier in a direction to reduce said disparity, in which said means for providing a demand signal is an on-off humidistat, said comparison means including fill and drain threshold comparator means and fill and drain means respectively actuable by said fill and drain comparator means for increasing and decreasing vapor generation capacity of said humidifier, and "off" interrupt means responsive to an "off" condition of said humidistat for preventing operation of said drain means by appearance of a drain threshold comparator output.

14. The apparatus of claim 13, in which said comparison means further includes an overcurrent drain threshold comparator means responsive to a substantially excessive vapor output signal for actuating said drain means to reduce humidifier vapor output independent of said drain threshold comparator.

15. A vaporizing humidifier, comprising:

vapor output capacity altering means actuable for gradually increasing and decreasing the vapor output of said humidifier;

means providing a vapor output signal indicating the instantaneous vapor output of said humidifier;

means providing a demand signal indicating the instantaneous demand for vapor;

timing means responsive to a demand signal remaining outside preset limits for more than a preset time interval for modifying one of said demand signal and vapor output signal in a direction to tend to match humidifier capacity to vapor demand; and comparison means responsive to a significant disparity between said modified signal and the unmodified one of said demand and capacity signals for causing said vapor capacity altering means to alter the vapor output capacity of said humidifier in a direction to reduce said disparity, in which said demand signal providing means comprises a proportional humidistat, said timing means including a signal level comparator means responsive to a humidistat output above an intermediate range for producing a first signal and responsive to a humidistat output below said range for producing a second signal, first and second timer means respectively responsive to the first and second signals for timing a respective timer interval, means for modifying one of said demand signal and vapor output signal such that said comparison means receives said modified signal and unmodified signal, said modifying means being actuable in response to timing out of said first timer means for modifying in one direction and being responsive to timing out of the second timer means for modifying in the other direction.

* * * * *